US007000761B2

(12) United States Patent
Swart et al.

(10) Patent No.: US 7,000,761 B2
(45) Date of Patent: Feb. 21, 2006

(54) SMOKING ARTICLE PACKAGE

(75) Inventors: Pierre Radyn Swart, London (GB); Hugh Dermot Roe, Somerset West (ZA)

(73) Assignee: British American Tobacco (Investments) Ltd., (GB)

( * ) Notice: Subject to any disclaimer, the term of this patent is extended or adjusted under 35 U.S.C. 154(b) by 56 days.

(21) Appl. No.: 10/432,076

(22) PCT Filed: Nov. 20, 2001

(86) PCT No.: PCT/GB01/05083

§ 371 (c)(1),
(2), (4) Date: May 19, 2003

(87) PCT Pub. No.: WO02/40378

PCT Pub. Date: May 23, 2002

(65) Prior Publication Data

US 2004/0011681 A1 Jan. 22, 2004

(30) Foreign Application Priority Data

Nov. 20, 2000 (ZA) ..... 2000/6767

(51) Int. Cl.
*B65D 85/10* (2006.01)

(52) U.S. Cl. ..... 206/271; 206/259; 206/273; 229/160.1

(58) Field of Classification Search ..... 206/242, 206/259, 268, 271, 273; 229/160.1
See application file for complete search history.

(56) References Cited

U.S. PATENT DOCUMENTS 1,956,325 A * 4/1934 Hart ..... 229/67.3
2,680,557 A * 6/1954 Madden ..... 229/120.18
3,058,581 A * 10/1962 Keating ..... 206/256
4,119,196 A * 10/1978 Flaherty ..... 206/271
5,097,948 A * 3/1992 Campbell ..... 206/268

* cited by examiner

*Primary Examiner*—David T. Fidei
(74) *Attorney, Agent, or Firm*—Pitney Hardin LLP

(57) ABSTRACT

The invention relates to a soft-cup package (29) for smoking articles wherein the outer wrap material (10) is a paperboard or cardboard material having the ability to collapse along lines of weakening (26, 28) in the side panels (16, 20) as smoking articles are removed from the package (29). The invention also includes further means of collapse along lines of weakening (14.2, 18.2) in the base panel (14.1, 18.1). Retaining means may he provided by a collapsed side panel (20) and a dummy stamp or seal (34) across the top walls of the package (10) to hold captive the remaining exposed smoking articles (46).

18 Claims, 2 Drawing Sheets

SMOKING ARTICLE PACKAGE

This invention relates to a package for smoking articles, such as, but not exclusively, cigarettes.

Two of the most popular types of cigarette packs include the hinged lid pack, or "hard-pack", and the so-called "soft pack".

Both of these packs typically comprise three separate wrappings, namely an inner foil liner in the form of a metallised or printed paper, or a metal foil laminated to a paper substrate which is then wrapped around the bundle of cigarettes and folded in at the ends of the bundles. A soft or hard paper or paperboard package carrying brand-specific information is wrapped around the inner liner as an outer wrap. An exterior outermost clear overwrap of a heat sealable film, typically cellophane, is then heat sealed around the outer wrap to preserve the freshness and moisture content of the cigarettes, and normally carries a strip of tear tape material to facilitate opening thereof.

The outer wrap of the hinged lid pack is in the form of a parallelepipedal lidded box folded from a relatively rigid cardboard or paperboard material. The box is generally crush proof, in that cigarettes contained within the box are protected against being crushed or squashed after the pack has been opened. A disadvantage of this pack is that it is relatively costly to produce.

The soft pack has an open-ended outer wrap formed from a paper material typically having a mass of 90 g/m$^2$. It therefore utilises less robust material and is generally more economical to manufacture than a hinged lid pack. Soft packs have also developed a certain "image" amongst a large body of smokers. It has been found that part of the attraction of a pack of this type includes the familiar ritual of opening the pack by tearing away a portion of the exposed inner liner to reveal the cigarettes. Due to their deformability, soft packs are less obtrusive than hard packs such as hinged lid packs, and can more comfortably be accommodated in pockets and the like.

A major drawback of soft packs is, however, the limited protection they provide for cigarettes within such packs, in particular where a number of cigarettes have already been removed.

U.S. Pat. No. 3,058,581 describes a self-thinning collapsible cigarette package which may comprise compartments of cigarettes, each compartment being collapsible as all the cigarettes are removed therefrom. In its most complex embodiment the package is provided with a "concertina" base, as well as sides. Other embodiments have collapsible sides with upper and lower caps. The simplest embodiment comprises two folded frames attached together by tape. In total, the collapsible package is complex to manufacture and produce.

More recently U.S. Pat. No. 4,119,196 describes an outer wrap for a soft cup, which outer wrap has front and rear panels joined by a base panel and two overlapping side wall panels, thereby providing double thickness side walls. The base panel is intricately cut and folded to provide means to prevent total collapse of the package. The cutting and folding lines are not suitable for fast moving production of blanks from carton board sheet.

It is an object of the invention to provide a new type of smoking article pack which overcomes certain disadvantages of the above mentioned soft and hinged lid packs.

It is a further object to provide a smoking article pack which has improved smoking article retention properties.

The present invention provides a smoking article package comprising an inner wrap containing a bundle of smoking articles, an outer wrap overlying the inner wrap, the outer wrap being a creased board material folded to define a parallelepipedal box having an open end, and an overwrap film overwrapping the box, the outer wrap comprising front and rear major panels, opposing side panels and a base panel, each side panel being provided with a crease line extending substantially parallel to a longitudinal edge of a side panel, the crease line at the base of the box bifurcating towards the corners of each side panel.

As used herein the term "crease line" means a line capable of folding therealong, i.e. a line of weakening, and may be a fold line, score line, perforation line or other line of weakening.

Preferably the base panel further comprises a crease line extending substantially parallel to a longitudinal edge thereof, the crease line at the ends thereof bifurcating towards adjacent corners of the base panel. The presence of crease lines in the package allows the package to compress but maintain some degree of protection for the remaining smoking articles. Advantageously the base panel collapses outwardly.

Advantageously the crease line in the side or base panel extends along the entire length of each of the panels.

Advantageously the crease line in the side or base panels may comprise two substantially parallel crease lines. The provision of a double crease line allows the package to compress to a dimension whereby the dimension between the two crease lines is about that of the diameter of a single cigarette.

Advantageously the board material is a paperboard or cardboard material having a mass in the range of 150 to 250 g/m$^2$, increasing at intervals of 10 g/m$^2$ within this range, more advantageously in the range of 200 to 230 g/m$^2$ and being typically of 215 g/m$^2$. The corresponding thickness may vary from 0.25 mm to 0.4 mm. A suitable board material is BATABAK board.

Preferably the blank of the outer wrap comprises major front and rear panels each adjoining side panels along a longitudinal edge of the front or rear panel. Such an arrangement reduces the amount of material overlap.

In the alternative the outer wrap may comprise major front and rear panels adjoined along a shorter edge by an intervening base panel.

In a preferred form of the invention, a seal or dummy stamp formed from a polymeric material bridges the top wall and is glued to upper outer faces of the opposed front and rear panels. The provision of a seal or dummy stamp of polymeric material provides a reaction edge to enable the consumer to peel open an exposed portion of the outer wrap at the top of the package. This arrangement makes opening of the package easier than in conventional soft cup packages.

Preferably, retaining means is provided for retaining the exposed smoking articles within an opened pack.

Typically, the retaining means is constituted by the opposed front and rear panels in combination with at least one of the creased side panels being arranged to deform in a W-configuration, with the crease defining an apex of the W-configuration, and the apex of the W-configuration extending towards an edge of the dummy stamp so as to displace the remaining exposed smoking articles, thereby at least a portion of each of the remaining exposed smoking articles is located behind and held captive by the dummy stamp or seal.

In order that the invention may be easily understood and readily carried into effect, reference will now be made to the accompanying diagrammatic drawings, in which.

Figure 1:
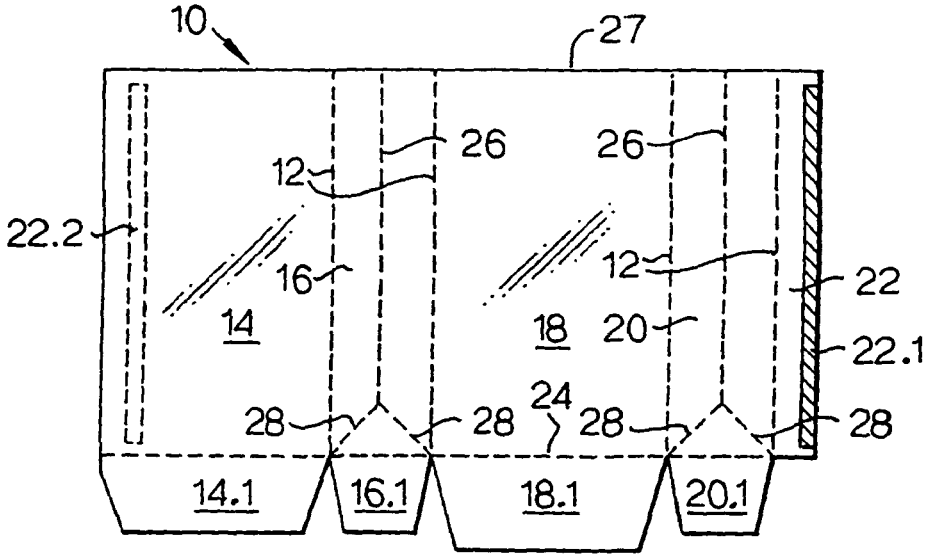
FIG. 1 shows a plan view of a blank of an outer wrap of a smoking article package of the invention.

Referring first to FIG. 1, a blank 10 for an outer wrap of a smoking article package of the invention is formed from paperboard material having a density of 215 g/m$^2$ and a thickness of 290 microns. The blank 10 is divided by vertical crease lines 12 into a rear panel 14, an adjoining side panel 16, a front panel 18, a side panel 20 and an adjoining glue tab or flap 22. Extending from the rear, front and side panels are respective base flaps 14.1, 16.1, 18.1 and 20.1 separated from the front, rear and side panels by a horizontal crease line 24 and arranged in combination to define a base wall when the blank is folded into a box. Similarly, the glue tab or flap 22 has a glue strip 22.1 arranged to be glued to a glue-receiving zone 22.2 on the undersurface of the rear panel 14.

Crease lines 26 are formed in the side panels 16 and 20, and extend from a top edge 27 of the blank towards the horizontal crease line 24. The crease line 26 branches into diagonal crease lines 28 which terminate at the lower corners of the side panels 16 and 20.

Figure 2:
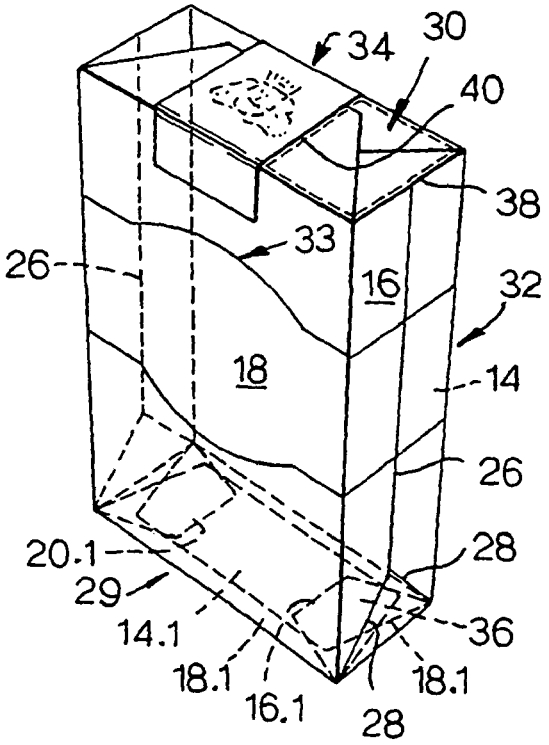
FIG. 2 shows a perspective view of a smoking article package of the invention formed from the blank of FIG. 1.

Referring now to FIG. 2, a perspective view of the smoking article package referenced 29 is shown. For the sake of clarity, the conventional overwrap cellophane film has been removed from the package. It is clear from FIG. 2 how the uppermost wall of the package is defined by exposed inwardly folded ends of the inner wrap 30. The inner wrap is conventional in form and comprises a metal foil laminated to a paper substrate or a metallised paper which is wrapped about the cigarettes and folded but not sealed at its bottom end and its top end 30. In FIG. 2, the blank 10 of FIG. 1 is shown folded into an open-ended parallelepipedal box 32 carrying printed and embossed brand-specific information 33. A dummy stamp or seal 34 forms a central closure over the top end wall of the package defined by the folded over inner wrap 30. The dummy stamp or seal is formed from clay coated polypropylene having a thickness of 40 $\mu$m. The dummy stamp adheres to the upper outer surfaces of the front and rear panels 18 and 14. The bottom flaps 14.1 to 20.1 are glued together in the manner illustrated in ghost outline in FIG. 2 to define a base wall 36 of the box 32, with the side wall flaps 16.1 and 20.1 overlying the rear wall flap 14.1, which in turn overlies the outermost front wall flap 18.1.

Figure 3:
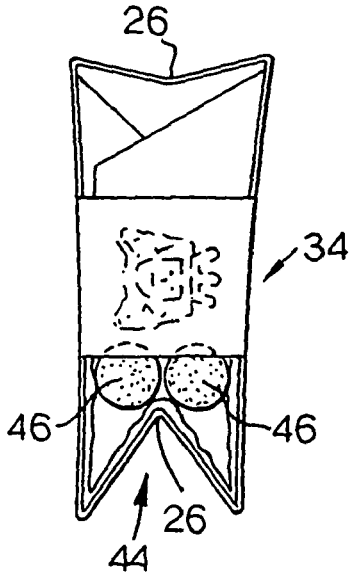
FIG. 3 shows a top plan view of the smoking article package of FIG. 2 in an opened condition.

The smoking article package 29 of FIG. 2 is opened by tearing away that portion of the inner wrap 30 surrounded in broken outline at 38, with the tear zone being defined by side edge 40 of the dummy seal 34 and the uppermost edges 27 of the box 32, which serve as tear anvils. Once a few cigarettes have been removed from the package, the opposed respective front and rear panels 18 and 14 are folded towards one another by inward deformation of the side panels 16 and 20 along the central fold lines 26 and the diagonal fold line 28, as is clear from FIG. 3. The fold lines 26 and 28 allow the package to be deformed inwardly, whilst still providing it with a measure of resistance against crushing. At the same time, it is clear from FIG. 3 how the W-profile 44 of the inwardly deformed package has the effect of displacing the remaining exposed cigarettes 46 at least partly beneath the dummy stamp or seal 34, as a result of which they are held captive behind the opened package, and cannot easily be shaken loose or accidentally fall out of the package.

Figure 4:
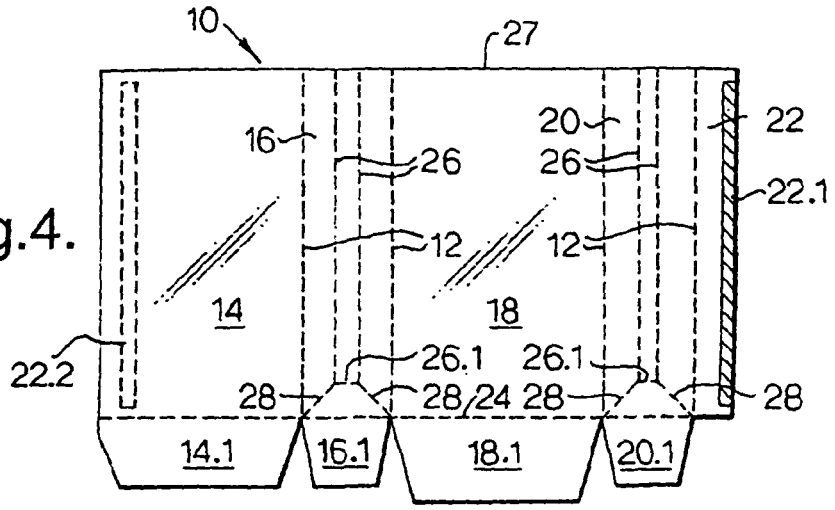
FIG. 4 shows a plan view of a blank of an outer wrap of a smoking article package according to a further embodiment of the invention.

Referring to FIG. 4, a blank 10 for an outer wrap of a smoking article package of the invention is formed similar to that drawn in FIG. 1. However, in this embodiment two crease lines 26 are formed in each of the side panels 16 and 20, and extend from a top edge 27 of the blank towards the horizontal crease lines 24. Each of the crease lines 26 divert into diagonal crease lines 28 that extend to respective adjacent corners of each of side panels 16 and 20. A second crease line 26.1 extends between the two crease lines 26 at their bottom extremity. The dimension between the two crease lines 26 is substantially equivalent to the diameter of a cigarette to be held therein.

Figure 5:
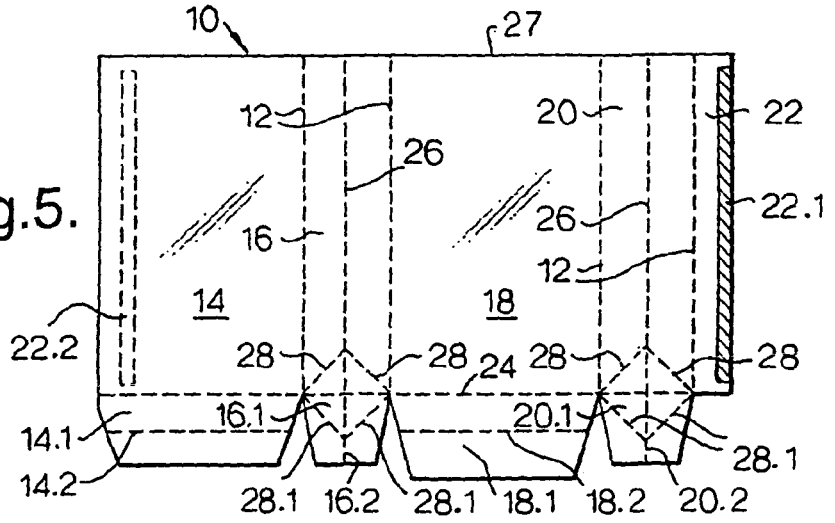
FIG. 5 shows a plan view of a blank of an outer wrap of a smoking article package according to a yet further embodiment of the invention.
Figure 6:
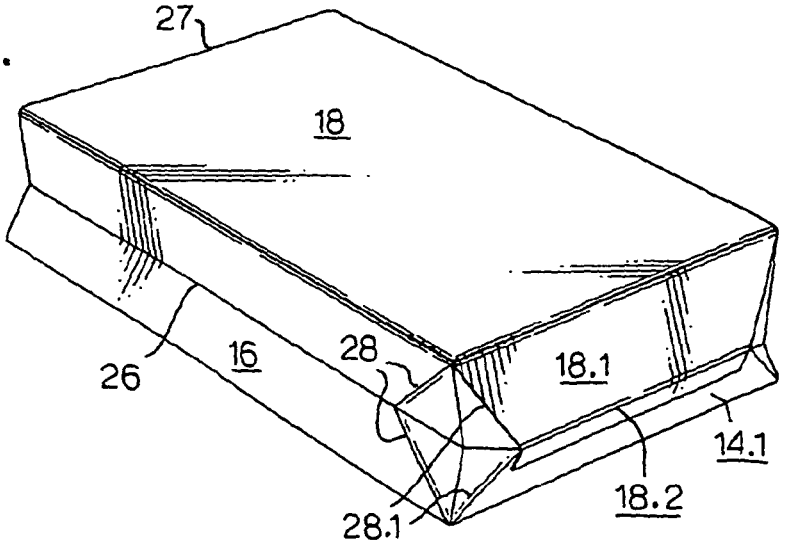
FIG. 6 shows the embodiment of FIG. 5 in perspective view.

FIG. 5 shows a blank according to FIG. 1 additionally having creases in the base panel. FIG. 6 shows the same pack in perspective view (from the base), thus illustrating the pack when collapsed. In order to facilitate folding in the base panel the width dimensions of one of the base flaps 18.1 or 14.1 may extend only to the crease line 18.2 or 14.2 to reduce the thickness in the fold area.

Advantageously the inner flap 14.1 has a reduced width. In addition it may be advantageous to vary or alter the dimensions of the base panel side flaps 16.1 and 20.1 to reduce the thickness in the fold area of the base panel.

A significant advantage of the package of the invention is that it combines the crush proof advantages of a conventional hinged lid pack with certain of the cost saving advantages associated with a so-called "soft" pack. Owing to the almost identical appearance of the smoking article package of the invention to that of a "soft" pack and the associated similar pack opening ritual, it is envisaged that the package of the invention will enjoy the image associated with a conventional soft pack without the smoker having to be inconvenienced by the practical non crush-proof disadvantages of such a pack.

What is claimed is:

1. A smoking article package comprising an inner wrap containing a bundle of smoking articles, an outer wrap overlying the inner wrap, the outer wrap being a creased board material folded to define a parallelepipedal box having an open end, and an overwrap film overwrapping the box, the outer wrap comprising front and rear major panels, opposing side panels and a base panel, each side panel having a base with two corners and being provided with a crease line extending substantially parallel to a longitudinal edge of a side panel, the crease line bifurcating towards the corners at the base of each side panel.

2. A package according to claim 1, wherein said base panel has a crease line extending substantially parallel to a longitudinal edge thereof, said crease line at the ends thereof bifurcating towards adjacent corners of said base panel.

3. A package according to claim 1, wherein each said side panel includes a second crease line substantially parallel to said longitudinal edge thereof.

4. A package according to claim 2, wherein said crease line in said base panel comprises two substantially parallel crease lines.

5. A package according to claim 1, wherein the board material is a paperboard or cardboard material.

6. A package according to claim 5, wherein the board material has a basis weight in the range of 150 to 250 g/m$^2$.

7. A package according to claim 6, wherein the board material has a basis weight in the range of 200 to 230 g/m$^2$.

8. A package according to claim 7, wherein the board material has a basis weight of 215 g/m$^2$.

9. A package according to claim 1, wherein said board material of the outer wrap comprises major front and rear panels each adjoining side panels along a longitudinal edge of the front or rear panel.

10. A package according to claim 1, wherein said board material of the outer wrap comprises major front and rear panels adjoined along a shorter edge by an intervening base panel.

11. A package according to claim 9, wherein said inner wrap includes a top wall, and wherein a seal or dummy stamp bridges the top wall and is glued to upper outer faces of opposed front and rear panels.

12. A package according to claim 11, wherein the seal or dummy stamp is formed from a polymeric material.

13. A package according to claim 11, wherein retaining means is provided for retaining the exposed smoking articles within an opened pack.

14. A package according to claim 13, wherein said retaining means is constituted by opposed front and rear panels in combination with at least one of the creased side panels being arranged to deform in a W-configuration, said crease defining an apex of said W-configuration, and said apex of said W-configuration extending towards an edge of said seal or dummy stamp so as to displace the remaining exposed smoking articles, thereby at least a portion of each of the remaining exposed smoking articles being located behind and held captive by said dummy stamp or seal.

15. A package according to claim 10, wherein a seal or dummy stamp bridges the top wall and is glued to upper outer faces of opposed front and rear panels.

16. A package according to claim 15, wherein the seal or dummy stamp is formed from a polymeric material.

17. A package according to claim 15, wherein retaining means is provided for retaining the exposed smoking articles within an opened pack.

18. A package according to claim 17, wherein said retaining means is constituted by opposed front and rear panels in combination with at least one of the creased side panels being arranged to deform in a W-configuration, said crease defining an apex of said W-configuration, and said apex of said W-configuration extending towards an edge of said seal or dummy stamp so as to displace the remaining exposed smoking articles, thereby at least a portion of each of the remaining exposed smoking articles being located behind and held captive by said dummy stamp or seal.

* * * * *